United States Patent [19]

Anzawa et al.

[11] Patent Number: 5,066,219

[45] Date of Patent: Nov. 19, 1991

[54] METHOD AND APPARATUS FOR BURNING LIQUID FUEL

[75] Inventors: Norio Anzawa; Koji Adachi; Tetsuo Futakawa; Hironari Sato; Akira Narita, all of Muroran, Japan

[73] Assignee: Nippon Steel Corporation, Tokyo, Japan

[21] Appl. No.: 500,782

[22] Filed: Mar. 28, 1990

[30] Foreign Application Priority Data

Mar. 31, 1989 [JP] Japan ..... 1-81237
Mar. 31, 1989 [JP] Japan ..... 1-81238

[51] Int. Cl.[5] ..... F23M 3/04

[52] U.S. Cl. ..... 431/10; 431/8; 431/335; 431/354

[58] Field of Search ..... 431/8, 334, 335, 331, 431/10, 354

[56] References Cited

U.S. PATENT DOCUMENTS

| | | | |
|---|---|---|---|
| 70,117 | 10/1867 | Post et al. | 431/335 |
| 1,378,689 | 5/1921 | Larson | 431/334 |

FOREIGN PATENT DOCUMENTS

| | | | |
|---|---|---|---|
| 47-38368 | 12/1972 | Japan . | |
| 49-42018 | 11/1974 | Japan . | |
| 58-35713 | 3/1983 | Japan . | |
| 58-203307 | 11/1983 | Japan . | |
| 60-64134 | 4/1985 | Japan . | |
| 578526 | 10/1977 | U.S.S.R. | 431/335 |
| 666382 | 6/1979 | U.S.S.R. | 431/335 |
| 953256 | 3/1974 | United Kingdom | 431/335 |

*Primary Examiner*—Carroll B. Dority
*Attorney, Agent, or Firm*—Wenderoth, Lind & Ponack

[57] ABSTRACT

A method and apparatus for burning a liquid fuel by introducing gas into the liquid fuel through capillaries, a porous plate, cloth, a particle layer or the like to bubble the liquid fuel to control the fuel level and simultaneously by supplying combustion air separately to accomplish complete combustion.

3 Claims, 5 Drawing Sheets

METHOD AND APPARATUS FOR BURNING LIQUID FUEL

BACKGROUND OF THE INVENTION

1. Field of the Invention

The present invention relates to a method and apparatus for burning liquid fuel in a wide range of applications from household oil stoves up to industrial furnaces.

2. Description of the Prior Art

A heretofore known practice is to burn liquid fuel which has been either directly gasified or which has been finely vaporized by an atomizer.

The former method of burning the directly gasified fuel is widely used in general household oil stoves, typical of which are a pot type (JU-A-No. 35713/1983), a wick type (JP-A-Nos. 203307/1983 and 64134/1985) and a vaporization type (JIS 3030).

The pot type employs a burner bowl in which fuel is vaporized before being burned and is equipped with a combination of vaporization and combustion units.

In the case of the vaporization type, fuel is vaporized in a vaporization chamber or pipe and then burned in a combustion unit, the vaporization unit being separated from the combustion unit.

Although the method of burning gasified fuel is used in some household oil stoves, it is more generally used in industrial furnaces, boilers and the like. This burning method is designed to promote vaporization and combustion reaction by gasifying liquid fuel into fine oil drops to increase the contact area of each drop with air.

Oil burners generally in use are adapted to burn fuel by means of a rotary burner, jet burner (vaporization spray, air spray and mechanical spray), special burner (gun-type high-pressure spray and low pressure spray) or the like. There are also examples having a kind of ignition device for igniting liquid fuel in the form of foam (JP-B-No. 42018/1974, JP-A-No. 38368/1972).

In the method of burning liquid fuel which is directly gasified using a pot, it is difficult to quickly increase combustion until the combustion chamber is sufficiently warmed after the fuel is ignited. Consequently, it takes time before such oil stoves radiate heat satisfactorily after the fuel is ignited. In the case of the wick-type burning method, the range over which combustion can be adjusted is small and, depending on atmospheric conditions and the room size, it may be impossible to obtain ideal heating.

Moreover, there is generated an offensive smell from oil stoves when fuel is ignited or the flame is extinguished and this has caused oil stoves to be known for their bad odor.

From the point of safety, the flame in an oil stove has to be extinguishable as quickly as possible (e.g., according to JIS, the flame in the oil stove has to be extinguished within 10 seconds after an earthquake occurs or when it is tipped over by accident). The offensive smell generated when it is turned off therefore tends to become stronger.

This means the flame of an oil stove is required to be extinguished as quickly as possible after flame extinguishment is initiated. In the case of an oil stove, for instance, fuel is prevented from being vaporized from the wick or pot after the flame is extinguished and it is oxidized into aldehydes producing an irritant smell while passing through the hot combustion chamber.

The problem is that the resulting strong offensive smell gives users an uncomfortable feeling.

Although there are many kinds of combustion equipment using the spray combustion method, they all allow groups of oil drops to have a wide distribution of particle sizes when they are dispersed by air; and these drops act on one another and move in different directions at different speeds.

As a result, spray combustion lacks uniformity, because oil drops insufficiently vaporized and mixed reach the front face of the flame before being enclosed in diffusion flame. The flame tends to become nonuniform, causing partial overheating of parts being heated.

Moreover, a device for spraying the oil is required and this results in high running costs such as high power cost.

In addition to the aforementioned disadvantages, the oil stoves proposed in JP-B-No. 42018/1974 and JP-A-No. 38368/1972 cannot be seen as ensuring continuous combustion with safety.

SUMMARY OF THE INVENTION

An object of the present invention is to provide a method for burning a liquid fuel wherein the liquid fuel is supplied to the exterior of a porous element, air is supplied to the interior of the porous element to convert the liquid fuel into foam constituted by a mass of small diameter bubbles, and the foamed fuel is immediately burned, and more particularly to such a method in which the fuel-air contact area is dramatically increased and the fuel vaporization and combustion reaction are enhanced.

DETAILED DESCRIPTION OF THE INVENTION

The present invention provides a method for burning liquid fuel which enables the amount of combustion in an oil stove to be freely adjusted, prevents the occurrence of an offensive odor at the time of ignition or extinguishment and enhances the uniformity of the flame. For achieving these advantageous effects, it provides a mode of operation in which the liquid fuel is first converted into a foam at a foaming expansion ratio (apparent volume/liquid fuel volume in the mixture of liquid and air) of 5–50 times and is then immediately burned continuously in a combustion chamber. The method achieves a particularly remarkable effect when employed in an oil space heater.

"Foam" is used in the present specification to mean a mass of bubbles separated by thin liquid films and thus refers to something that is essentially different from one or more bubbles within a liquid.

The burning of liquid fuel in the form of foam is characterized by features not seen in earlier combustion methods. One of these is that since the liquid fuel is burned in the form of a foam of small-diameter bubbles having a continuous liquid film phase, the contact area between the fuel and the air becomes large. Another is that there is an appreciable improvement in air retention capability which results in a prolongation of the contact period. Other advantages are an increase in the vaporization dispersion coefficient and a reduction in the partial pressure of the air-liquid interface, which combine to promote fuel vaporization and combustion reaction.

A description will subsequently be given of the present invention with reference to the accompanying drawings.

Figure 1:
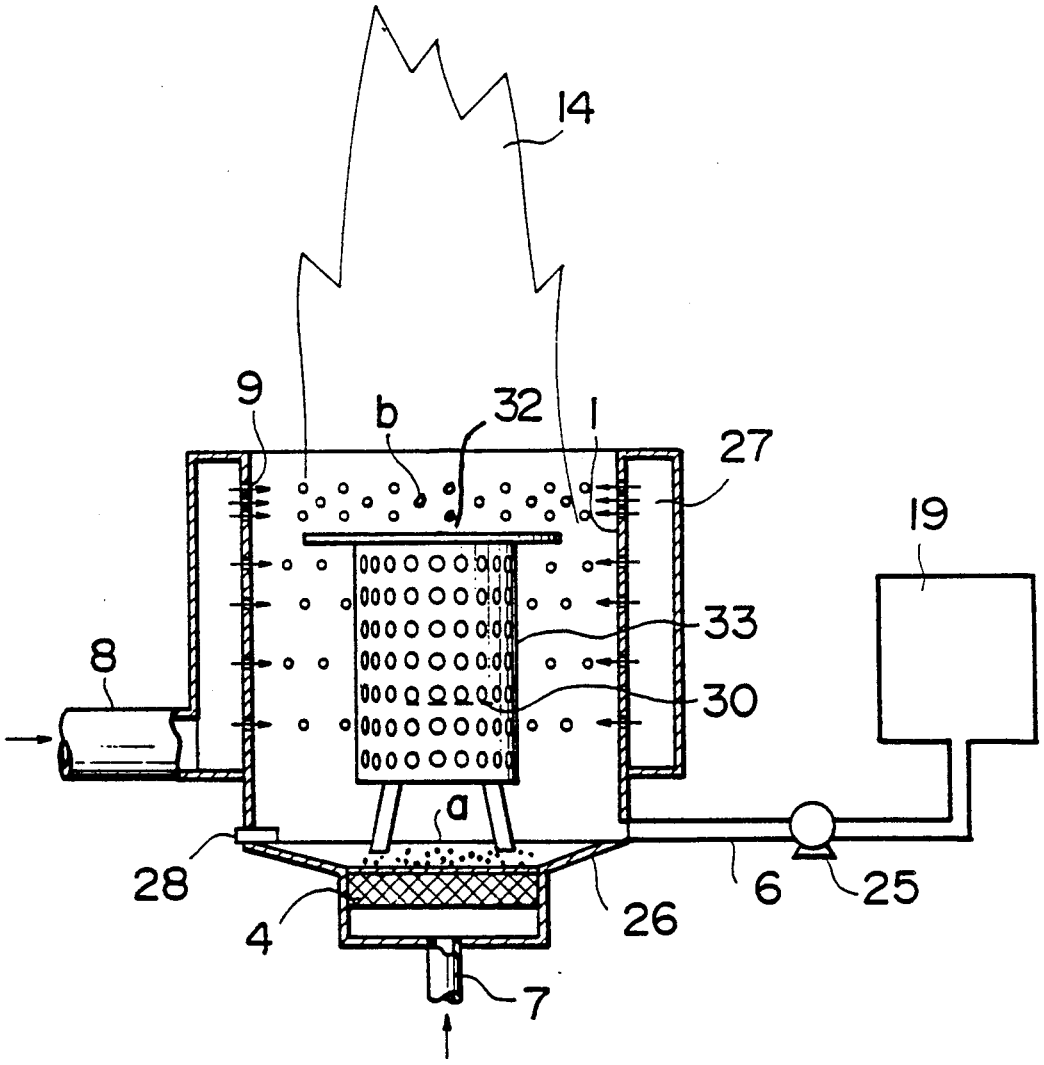
FIG. 1 is a vertical sectional view of a burner embodying the present invention.

In FIG. 1, numeral mostly as 4 denotes a porous element (hereinafter referred to mostly as the air feeder) which functions as a fuel foamer and 26 an evaporating dish. Fuel is supplied from a fuel tank 19 via a pump 25 and a supply pipe 6 to a combustion chamber 1. The inverted cone-shaped evaporating dish 26 and the air feeder are disposed under the combustion chamber 1. The combustion chamber 1 is provided with a closed jacket 27 for supplying combustion air. The positional relationship between the air feeder 4 and the evaporating dish 26 is such that the surface of the air feeder 4 and the lower end of the evaporating dish 26 may be at the same level or different in level.

"Porous element" is used herein as a general term meaning capillaries, cloth, particle layer, porous plate having holes, sinter metal, porous ceramic or the like.

Liquid fuel is supplied to the evaporating dish 26 disposed on the foamer 4. A fuel air supply pipe 7 communicates with the underside of the foamer 4. Since air is supplied through the pipe 7 while the supply of fuel is begun, substantially the whole amount of the supplied fuel (kerosene, light oil or the like) is immediately converted to foam at a foaming expansion ratio of 5–50 times before it is ignited and burned. The resistance of the porous element to the passage of air is very small and thus is what causes the immediate conversion to foam. The amount of combustion air required for complete combustion is separately supplied from a supply pipe 8 via the closed jacket 27 to cause continuous combustion. Numeral 14 denotes a flame.

The fuel is supplied via the fuel supply pipe 6 and the generation of foam is increased by increasing the amount of air supplied from the air supply pipe 7. The amount of combustion can readily be increased by increasing the amount of air supplied from the combustion air pipe 8. As the amount of gas (air) supplied from the air supply pipe 7 is increased while the amount of fuel thus supplied is kept constant, the flame grows.

The aforementioned results seem to come about from the fact that the amount of the liquid fuel vaporized is improved enough to increase the amount of combustion due to the following effects: an increase in the vaporization surface area of the liquid fuel as the foaming of the fuel is promoted, an increase in a liquid-to-gas diffusion coefficient, and a decrease in partial fuel vapor pressure on the liquid-gas boundary surface. It also becomes possible to make the combustion chamber 1 compact.

Since liquid fuel is formed into a foam of bubbles before being ignited according to the present invention, it can easily be ignited simply by directly contacting an ignition source with the foamed fuel.

When the flame is to be extinguished, first the supply of fuel to the combustion chamber 1 is stopped and then the fuel left in the combustion chamber is bubbled into foam before being burned, so that the time required until the fire is extinguished after the supply of fuel is stopped can be shortened. The fact that substantially all of the liquid fuel on the porous element is present in a foamed state makes is possible to extinguish the flame simply by stopping the supply of fuel to the combustion chamber 1, in as little as several tens of seconds and without leaving any film in the foamer. In addition, no offensive smells are produced.

Since fuel that has been once bubbled into foam is burned, the amount of combustion and the combustion characteristics such as the flame shape are freely controllable by regulating the amount of air blown from the air supply pipe 7, the amount of fuel supplied, and the amount of air supplied from the air supply pipe 8. Moreover, instant heat generation and combustion free of any offensive smell, that have been unattainable by the prior art oil stoves, become possible.

A description will subsequently be given of the reason for the supply of air through the combustion air pipe 8 separately from the air supplied through pipe 7 according to the present invention.

The foaming expansion ratio (apparent volume/liquid fuel volume in the mixture of liquid and gas) attainable with liquid fuel such as kerosine, light oil or the like by itself generally ranges from approximately 5 to 50 times, which is adequate for promoting fuel vaporization and causing the fuel vapor to come within a combustible range. This foaming expansion ratio is also used in the present invention. However, the air expansion ratio required for complete combustion is approximately 9,000 times and the amount of air within the bubbles of the foam is far too small.

Notwithstanding, some air supplied from the air supply pipe 7 will not be left in the foam but will be directly utilizable for combustion. The amount of air supplied from the combustion air pipe 8 should preferably be in the range of approximately 60–250% of the theoretical amount of combustion air.

The reason for setting the lower limit at 60% will be explained.

During a stable combustion period in the normal state, stable combustion generally continues unless liquid fuel above the air feeder 4 is blown off by the air supplied from the air supply pipe 7. In other words, 60% indicates a minimum flow rate of air from the combustion air pipe 8 for maintaining an optimum combustion state by increasing the flow rate of air above that from the air supply pipe 7 up to a stable combustion limit.

The reason for setting the upper limit at 250% will now be explained.

In a method of burning liquid fuel in the form of foam a stable formation of foam is required particularly during a transition period from the time the flame is ignited up to the time that stable combustion is obtained. In other words, 250% as the upper limit indicates a minimum flow rate of air from the combustion air pipe 8 when the amount of air from the air supply pipe 7 is set at the minimum value required for the stable formation of foam.

It is also possible to promote the combustive reaction by adding a polymer or, a surface active agent to liquid fuel to increase the foaming expansion ratio.

When the combustion of foam is utilized for burner combustion for heating an object to be heated, there are still some problems of making the cell size of the foam uniform and stabilizing the foaming properties if a liquid fuel other than light oil whose temperature is lower than the boiling point is used alone to generate foam. Consequently, the liquid fuel is mixed with a foaming agent such as a polymer, a surface active agent, silicon resin or the mixture thereof, or light oil having good foaming properties. The surface viscosity is increased thereby, whereas surface tension is decreased, so that the foaming properties are improved. The stable formation of foam thus becomes possible and the combustion of foam promotes a stable uniform flame with the effect of preventing local heating of parts of material to be heated. [Embodiments]

An air feeder 4 for generating foam and dispersed foam of liquid fuel and a fuel supply pipe 6 were provided under a combustion chamber 1 and a air supply pipe 7 was connected to the air feeder 4 to form a foam generating zone A number of combustion air inlet openings 9 were provided in the upper side portion of the combustion chamber to form a combustion zone b where liquid fuel was burned. The air feeder 4 comprised a porous element having a foaming function, the bottom being pot-shaped.

In operation, 80 l/min of combustion air was supplied from a combustion air supply pipe 8 via a closed jacket 27 and the air inlet openings 9 into the combustion chamber 1. At the same time, approximately 0.8 l/min of air was sent to the air supply pipe 7, 0.5 l/H of fuel (kerosine) having a temperature of 2° C. was subsequently supplied from a fuel tank 19 via the supply pipe 6 to the combustion chamber 1. Bubbles of the fuel were generated in the air feeder (porous plate of sintered metal) to form a foam which rose to an igniting heater 28 where it was ignited with a red hot Nichrome wire.

The combustion state at this time was such that the mixture of the fuel with the combustion air was promoted in a flame stabilizer 30 to the extent that a blue-white flame extended upward in the flame stabilizer 30, i.e., complete combustion was realized. The time required for the flame to be produced in the upper portion of the flame stabilizer 30 after ignition was as short as 20 seconds.

As the amount of air from the combustion air supply pipe 8 was decreased, the length of the flame became gradually longer and the flame began to show an orange color.

When the amount of air from the air supply pipe 7 was gradually increased in that combustion state to promote the foaming of the fuel, the length of the flame grew longer and the color thereof changed to blue-white. However, the amount of the fuel being supplied was unable to keep up with the operation and the length of the flame became short. The reason for this seems attributable to the fact that the amount of combustion increases temporarily as the promotion of foaming the liquid fuel increases the amount of fuel being vaporized, thus causing the residence time of the fuel in the form of liquid in the combustion chamber to become shorter.

Subsequently, the amount of fuel being supplied was increased up to 1.0 l/H, whereas the amount of combustion air was set at 160 l/min. The flame grew to become blue-white instantly on the flame port plate and stable combustion was continued.

When the supply of the fuel was stopped, the combustion of the fuel left in the combustion chamber was immediately terminated because of foam combustion. The fire was completely extinguished when the supply of air from the air supply pipe was suspended. No offensive smell was produced at that time.

The stabilizer 30 is constituted by a cylindrical sleeve 33 fitted to the underside of a baffle plate 32 and having holes bored therein The stabilizer is mounted coaxially with the porous element.

Although a porous plate with holes of a sufficiently small diameter for attaining a foaming expansion ratio of 5–50 times was used as the air feeder in this experiment, alternatively there can be used capillary tubes, cloth, a particle layer or a combination of two or more of these. However, the material and shape of such a porous element are not limited to those described in the embodiment shown.

Another embodiment of the present invention will subsequently be described.

Figure 2:
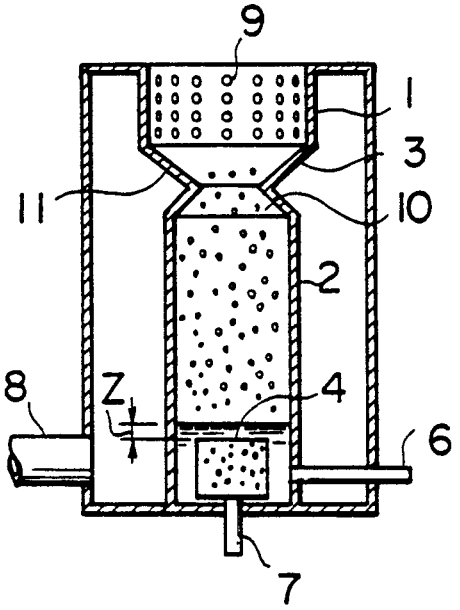
FIG. 2 is a vertical sectional view of another burner embodying the present invention.
Figure 3:
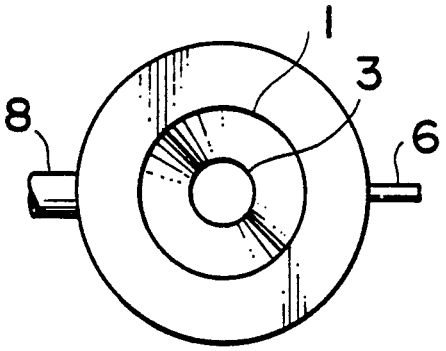
FIG. 3 is a top plan view of FIG. 2.

In FIGS. 2 and 3, numeral 1 denotes a combustion chamber, 2 a foam gathering cylinder, 3 an orifice, and 4 an air feeder. A fuel supply pipe 6 for supplying liquid fuel is connected to the underside of the foam gathering cylinder 2.

A foaming air supply pipe 7 is connected to the lower portion of the air feeder 4 so that gas such as air can be supplied from the outside. Numeral 8 denotes an air supply pipe, and 9 secondary air supply holes.

The orifice is located in the lower portion of the combustion chamber 1, which is a cylindrical or polygonal body and provided with a number of the secondary combustion air inlet openings 9.

The bubbled fuel is introduced from the foam gathering cylinder 2 into the orifice before being supplied to the combustion chamber 1. The air contained in the foam and what is supplied from the air inlet openings 9 make the fuel readily burn with its flame formed thereabove.

Figure 4:
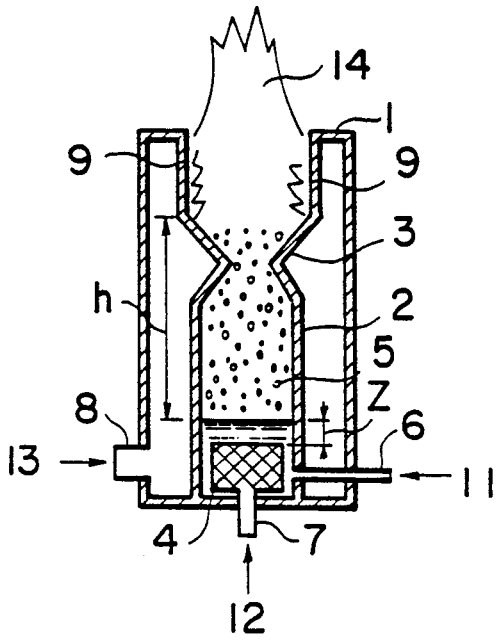
FIG. 4 is a view similar to FIG. 2 illustrating the burner of FIG. 2 carrying out combustion.

FIG. 4 shows combustion of liquid fuel according to the present invention in the burner of FIG. 2. Reference character h denotes the height of the foam, whereas numeral 11 denotes fuel, 12 foaming air, and 13 combustion air. The air feeder 4 is made of sintered metal, porous ceramic or the like. The liquid fuel supplied to the foam gathering cylinder 2 is caused to readily foam by the fine air current jetted out of the air feeder 4.

If the liquid level z of the fuel at the air feeder 4 installed inside the foam gathering cylinder 2 is increased, the amount of combustion increases as the fuel rising through the foam gathering cylinder 2 and supplied to the combustion chamber 1 increases to cause an increase in the thickness of the liquid film of foam even though the amount of air supplied from the foaming air supply pipe 7 is kept constant.

On the contrary, if the liquid level is decreased, the generation of foam is also decreased as is the amount of combustion.

A detailed description will subsequently be given of a method of controlling the liquid level z of the liquid fuel at the air feeder 4.

Figure 5:
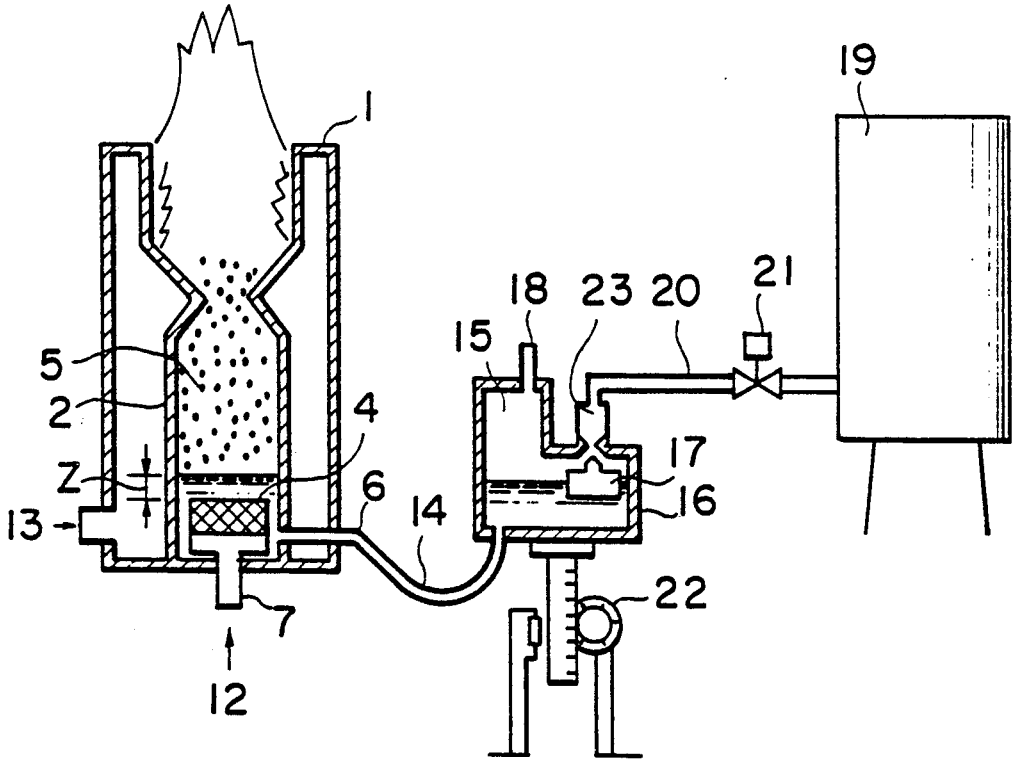
FIG. 5 is a diagrammatic partly sectional view illustrating an apparatus for controlling the amount of combustion by vertically moving a liquid level adjusting tank.

FIG. 5 shows an apparatus for controlling the combustion of liquid fuel by vertically moving a small tank having a built-in float to change the liquid level in the foam gathering cylinder.

A liquid level regulating tank 16 is connected via a flexible hose 14 to a fuel supply pipe 6. The liquid level regulating tank 16 has a built-in float 17 and is provided with a liquid reservoir 15 and an air vent hole 18, whereas a fuel hose 20 from a fuel tank 19 is connected to the liquid level regulating tank 16, the fuel hose being fitted with a fuel flow rate regulating valve 21.

At some point in time the level of fuel flowing into the liquid level regulating tank 16 reaches a preset position as the fuel supplied to the air feeder 4 flows backward when the supply of fuel from the fuel tank 19 and the liquid level are decreased. Then the liquid regulating tank functions to shut a needle valve 23 provided on the surface of the float by making use of the buoyant force acting on the float 17 and so interrupt the supply of fuel from the fuel tank.

The liquid level regulating tank 16 and the fuel supply pipe 6 are coupled via the flexible hose 14 and they communicate with each other. When the amount of combustion is to be increased, a liquid level regulating tank elevator 22 is used to raise the position of the liquid level regulating tank.

At this time, the balance between the liquid level inside the combustion chamber and that in the liquid level regulating tank 16 is upset and fuel is supplied to the combustion chamber therefrom. The float 17 then descends for opening the needle valve 23 widely. Fuel is thus supplied from the fuel tank 19. When the amount of combustion in the present state is to be decreased, the position of the liquid level tank 16 is lowered from the present position.

At this instant, fuel flows backward from the foam gathering cylinder 2 to the liquid level regulating tank 16 and the float 17 ascends, whereby the needle vale 23 is shut. The supply of fuel from the fuel tank is thereby intercepted.

While combustion is continued, the fuel that has flowed backward into the liquid level regulating tank decreases and when its level reaches what has been preset, the float descends and the supply of fuel from the fuel tank is restarted.

When the flame is to be extinguished, the position of the liquid level regulating tank is lowered until the fuel level in the foam gathering cylinder is located below the lowermost portion of the hole of the air feeder to cause fuel to flow to the liquid regulating tank.

The fuel that has been caused to flow in is temporarily stored in the liquid reservoir 15. At the time of ignition, the liquid level regulating tank is raised by the elevator 22 up to the liquid level z corresponding to the required amount of foam to be generated.

Figure 6:
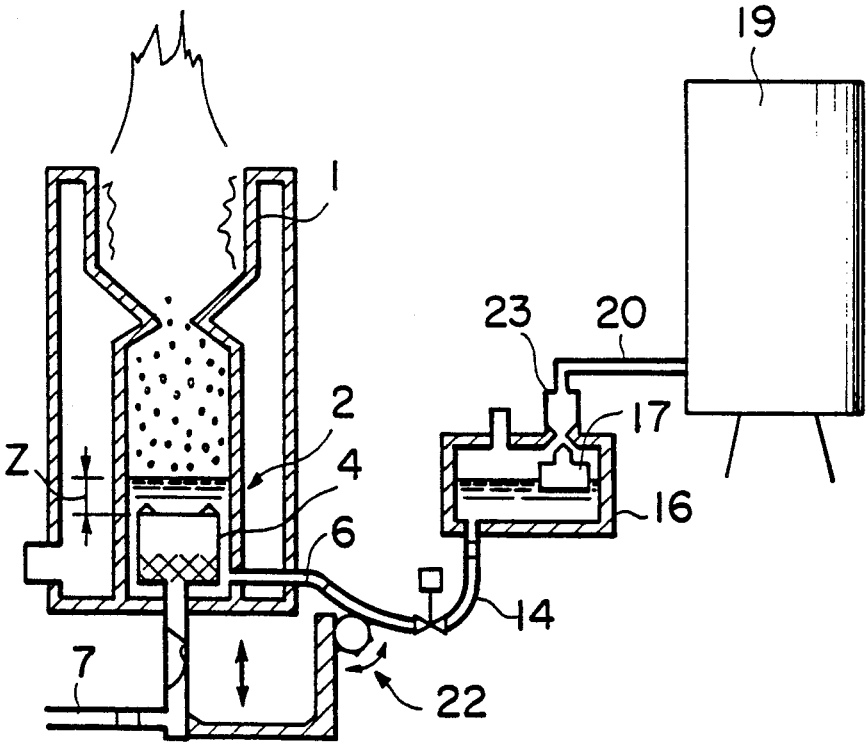
FIG. 6 is a view similar to FIG. 5 illustrating an apparatus for controlling the amount of combustion by vertically adjusting a air feeder.

FIG. 6 shows another apparatus embodying the present invention wherein combustion is controlled by elevating an air feeder 4 to change the liquid level of liquid fuel relative to the air feeder.

A foaming air supply pipe 7 is connected to the air feeder 4 provided in a foam collecting cylinder 2 coupled to the lower portion of a combustion chamber 1.

The air supply pipe 7 is equipped with an elevator 22 for vertically moving the air feeder and a desired liquid level can be set by moving the elevator manually or by the operation of a motor.

A fuel supply pipe 6 is connected to the lower portion of the foam collecting cylinder 2 and also coupled to a liquid level regulating tank 16.

The liquid level regulating tank 16 has a built-in float 17, and fuel from a fuel tank 19 is supplied thereto by a fuel hose 20, whereby fuel is supplied when a needle valve 23 opens and shuts as the float 17 moves vertically.

A method of regulating the liquid level using this apparatus will be described.

The liquid level regulating tank 16 is designed to keep the liquid level in the air feeder 4 at a predetermined height at all times during combustion and to continuously replenish the fuel to the extent that the liquid level in the air feeder lowers because of consumption of fuel during combustion. Since the liquid level regulating tank 16 and the air feeder 4 are coupled together by means of a fuel coupling pipe (flexible hose) 14, the liquid levels in both of them will be equal.

When the amount of combustion in this apparatus is to be decreased, the air feeder 4 is raised from an initial position. The distance between the air feeder 4 and the liquid fuel level within the foam gathering cylinder 2 is shortened, i.e., the liquid depth z is reduced and the amount of bubbles to be generated is decreased. The amount of combustion is also decreased.

When the air feeder 4 is lowered, the liquid depth z is increased and the amount of foam to be generated is increased. The amount of combustion is also increased.

When the flame is to be extinguished, the air supply to the air feeder 4 is stopped and the generation of foam is thereby stopped. With the suspension of the foaming, in the absence of some preventive measure, the liquid fuel remaining in the lower portion of the foam gathering cylinder 2 is caused to flow via the holes in the air feeder into the air feeder 4 and further into the air supply pipe 7. An increased pressure drop is therefore caused at the time of the next turning on of the burner and gas may not be stably supplied.

Figure 7:
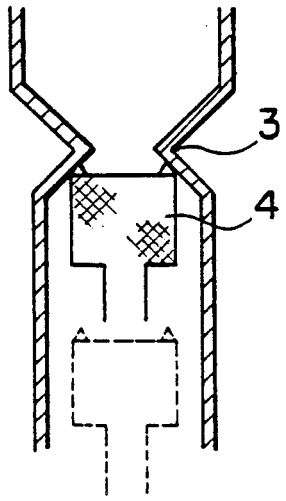
FIG. 7 is a diagrammatic sectional view illustrating a part of the apparatus for extinguishing a flame.

Therefore, to prevent this, when the flame is to be extinguished the whole air feeder 4 is raised from the liquid fuel contained in the foam gathering cylinder so as to be exposed above the liquid fuel and stop the supply of gas into the fuel, while the supply of gas to the air feeder 4 is continued. As shown in FIG. 7, the air feeder 4 is raised until it contacts the orifice 3 at the entrance of the combustion chamber and the flame is quickly extinguished.

At the time of the next ignition, foaming gas is supplied to the porous air feeder 4 as it is lowered and immersed in the liquid fuel.

A description will be given of still another embodiment namely the present invention, of a method of controlling the amount of combustion by changing the flow rate of gas supplied to the air feeder while the liquid level in the air feeder is kept constant.

When the flow rate of foaming air 12 is increased while the liquid depth z of liquid fuel in the air feeder 4 installed within the foam collecting cylinder 2 of FIG. 4 is kept constant, the amount of foam 5 generated in the foam collecting cylinder 2, i.e., the amount of liquid fuel for use in forming bubbles to be supplied to the combustion chamber 1 is increased. The amount of combustion is thus increased. When the flow rate of foaming air 12 is decreased, the amount of foam 5 generated is decreased. The amount of combustion is therefore decreased.

A description will be given of still another embodiment of the present invention, a method of controlling combustion by a combination of controlling the liquid level of liquid fuel in the air feeder installed in the foam gathering cylinder and of controlling the flow rate of gas supplied to the air feeder.

Figure 8:
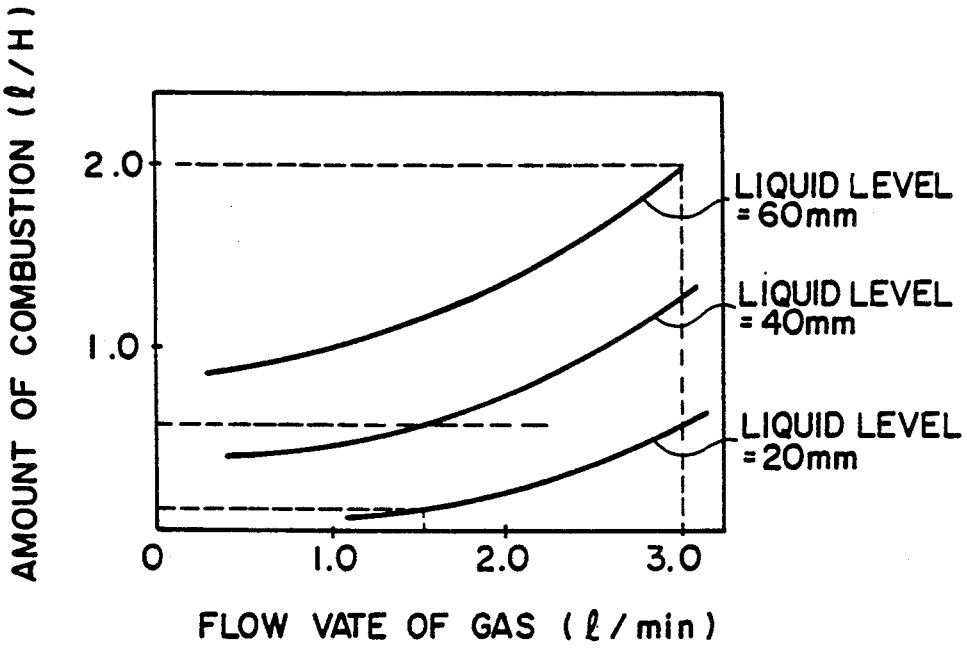
FIG. 8 is a chart showing the ranges over which the amount of combustion can be varied by adjusting the amount of air supplied to the air feeder at different liquid levels.

When it is desired to enlarge the range over which the amount of combustion can be adjusted in a single combustion chamber, the characteristics of the amount of combustion shown in FIG. 8 are utilized to facilitate the control of two factors: the liquid level and the flow rate of gas.

A specific embodiment of this will be described with reference to FIGS. 5 and 8.

With the liquid depth z of liquid fuel in the air feeder being 60 mm and foaming air 12 being supplied at 3.0 l/min, the amount of combustion was 2.0 l/H in terms of the consumption of kerosine while stable combustion was continued.

When the liquid depth was changed to 20 mm under the same conditions, the consumption of kerosine decreased to 0.6 l/H. When foaming air 12 was decreased to 1.5 l/min under the same conditions, the consumption of kerosine decreased to 0.1 l/H.

By controlling the two factors in this way, the range of the amount of combustion can be widened. However, the present invention is not limited to the method of controlling these factors.

We claim:

1. A method of burning a liquid fuel in an apparatus for burning liquid fuel which has a combustion chamber and a liquid fuel foamer having a top and a bottom in the bottom of the combustion chamber having a porous element with only the top exposed to the interior of the combustion chamber, the method comprising the steps of:

supplying a shallow layer of liquid fuel onto the top of the porous element;

supplying air for foaming to the bottom of the porous element from beneath the porous element in an amount to cause substantially all the liquid fuel to be immediately converted into foam at a foaming expansion ratio of 5–50 times;

causing the resulting foam to enter the combustion chamber; and supplying combustion air separately from the foaming air and mixing it with the foam in the combustion chamber for burning the foam.

2. An apparatus for burning a liquid fuel, comprising:

a combustion chamber having air inlet holes in the wall thereof;

an inverted cone-shaped evaporating dish opening upwardly into the combustion chamber;

a liquid fuel foamer including a porous element having a top and a bottom and disposed beneath and having only the top in communication with the bottom of said evaporating dish, and a foaming air supply pipe directed to the bottom of said porous element;

a fuel supply pipe opening into the bottom of said combustion chamber and onto the evaporating dish; and a closed jacket surrounding the outside of said combustion chamber and having means for supplying combustion air thereinto and into said combustion chamber through said inlet holes.

3. An apparatus as claimed in claim 2 further comprising a flame stabilizer in said combustion chamber and having a vertically positioned cylindrical sleeve having holes therein and in alignment with a vertical axis through the porous element.

* * * * *